US011440755B2

(12) United States Patent
Zhu et al.

(10) Patent No.: US 11,440,755 B2
(45) Date of Patent: Sep. 13, 2022

(54) AUTOMATIC LIFTING FEEDING DEVICE AND METHOD

(71) Applicant: OURSUN OFFICE MACHINE CO., LTD, Shenzhen (CN)

(72) Inventors: Wenfeng Zhu, Shenzhen (CN); Songyu He, Shenzhen (CN)

(73) Assignee: OURSUN OFFICE MACHINE CO., LTD, Shenzhen (CN)

( * ) Notice: Subject to any disclaimer, the term of this patent is extended or adjusted under 35 U.S.C. 154(b) by 402 days.

(21) Appl. No.: 16/626,881

(22) PCT Filed: Nov. 3, 2017

(86) PCT No.: PCT/CN2017/109352
§ 371 (c)(1),
(2) Date: Dec. 27, 2019

(87) PCT Pub. No.: WO2019/084915
PCT Pub. Date: May 9, 2019

(65) Prior Publication Data

US 2020/0130969 A1 Apr. 30, 2020

(30) Foreign Application Priority Data

Oct. 31, 2017 (CN) ..... 201711046947.6

(51) Int. Cl.
*B65H 1/18* (2006.01)
*B65H 3/06* (2006.01)
(Continued)

(52) U.S. Cl.
CPC ..... *B65H 1/18* (2013.01); *B65H 1/14* (2013.01); *B65H 3/0661* (2013.01); *B65H 7/18* (2013.01);
(Continued)

(58) Field of Classification Search
CPC ... B65H 1/08; B65H 1/14; B65H 1/18; B65H 7/02; B65H 7/04; B65H 7/18;
(Continued)

(56) References Cited

U.S. PATENT DOCUMENTS

2010/0133745 A1* 6/2010 Ikeuchi ..... B65H 7/02 271/265.04
2015/0336757 A1* 11/2015 Kumagai ..... B65H 3/02 271/265.01
(Continued)

FOREIGN PATENT DOCUMENTS

CN 101264831 A 9/2008
DE 3136544 A1 3/1983
(Continued)

*Primary Examiner* — Prasad V Gokhale
(74) *Attorney, Agent, or Firm* — Bayramoglu Law Offices LLC

(57) ABSTRACT

An automatic lifting and feeding device includes a main controller, a material thickness detecting device, a material loading mechanism for placing materials and driving the materials to rise and fall, a material taking mechanism for transferring materials and a height detecting mechanism for detecting the height of the materials, wherein, the material thickness detecting device, the material loading mechanism, the material taking mechanism and the height detecting mechanism are respectively connected to the main controller. The height detecting mechanism includes a bracket and the height testing part connected to the bracket, and the detector for detecting the material distance is arranged on the height testing part. The invention also provides an automatic lifting feeding method. The advantage of the invention is that the height does not need to be adjusted manually. The device can automatically detect the height of the material, and achieves high efficiency.

6 Claims, 1 Drawing Sheet

(51) Int. Cl.
*B65H 7/20* (2006.01)
*B65H 7/18* (2006.01)
*B65H 1/14* (2006.01)

(52) U.S. Cl.
CPC ..... *B65H 7/20* (2013.01); *B65H 2511/13* (2013.01); *B65H 2511/152* (2013.01); *B65H 2553/22* (2013.01); *B65H 2553/612* (2013.01); *B65H 2553/81* (2013.01)

(58) Field of Classification Search
CPC ..... B65H 2511/15; B65H 2511/152; B65H 2511/13; B65H 2553/22; B65H 2553/61; B65H 2553/612; B65H 2553/81
See application file for complete search history.

(56) References Cited

U.S. PATENT DOCUMENTS

| | | | | |
|---|---|---|---|---|
| 2016/0122144 | A1* | 5/2016 | Fukumoto ..... | B65H 5/062<br>271/11 |
| 2016/0137446 | A1* | 5/2016 | Mizobe ..... | B65H 1/04<br>271/265.01 |

FOREIGN PATENT DOCUMENTS

| | | | |
|---|---|---|---|
| JP | H01220645 | A | 9/1989 |
| JP | 2000327176 | A | 11/2000 |
| JP | 2007297150 | A | 11/2007 |

* cited by examiner

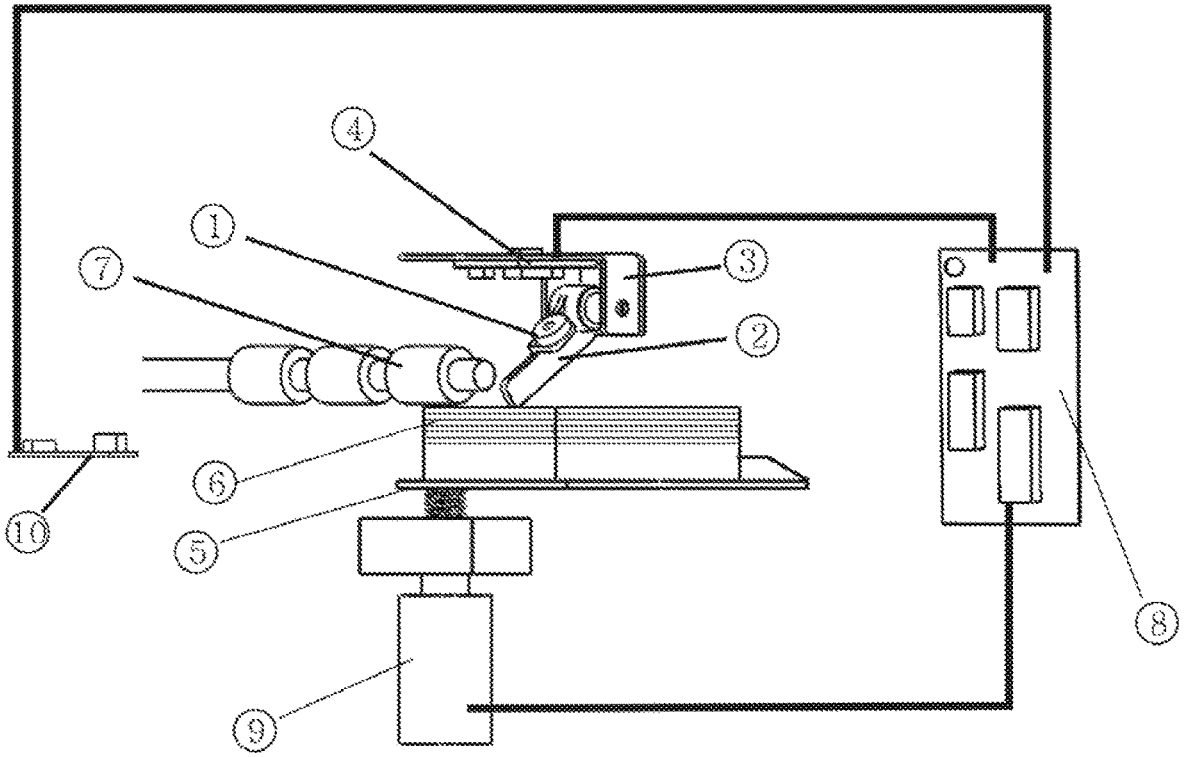
4
1
7
3
2
6
10
5
8
9

AUTOMATIC LIFTING FEEDING DEVICE AND METHOD

CROSS REFERENCE TO THE RELATED APPLICATIONS

This application is the national phase entry of International Application No. PCT/CN2017/109352, filed on Nov. 3, 2017, which is based upon and claims priority to Chinese Patent Application No. 201711046947.6, filed on Oct. 31, 2017, the entire contents of which are incorporated herein by reference.

TECHNICAL FIELD

The invention relates to a feeding device, in particular to an automatic lifting feeding device and a method thereof.

BACKGROUND

In an automatic feeding device, the material is placed on a liftable material loading mechanism when flexible material is used. After the material taking mechanism takes the material each time, the heights of the material and the material taking mechanism need to be measured. The whole material placing mechanism is automatically raised to an appropriate position to correctly pick up the next material.

At present, a rotating or a vertical lifting light blocking sheet and a photoelectric sensor or a light touch mechanical sensor are required to determine the heights of the material and the material taking mechanism. The light blocking sheet being lifted by the material, causes blockage of the sensor therefore, determining whether the material is at an appropriate height or not and thereby controlling the lifting of the material loading mechanism. If the position between the light blocking sheet and the sensor is not appropriate or the material changes, the lifting height of the material loading mechanism is not appropriate, the proper lifting height of the material loading mechanism is obtained by manually adjusting the relative distance and position of the light blocking sheet and the sensor, thereby controlling the lifting height and lifting time of the material placing mechanism.

The above traditional structure has the following defects:

1. Human interaction is required, in this case, an experienced individual to make adjustment to obtain the appropriate height. This affects efficiency as human interaction is required.

2. Because the heights of the material and the material taking mechanism are not in the appropriate position, it will cause the material taking failure. In this case, manual adjustment cannot quantify the height data, cannot automatically adjust the materials of different thicknesses and weights, when there are a variety of materials, the test has to be performed repeatedly, and obtaining a good height adjustment will cause a large amount of material waste, and affect the work efficiency.

SUMMARY

In order to solve the problem in the prior art, the invention provides an automatic lifting feeding device and a method.

The invention provides an automatic lifting feeding device, including a main controller, a material thickness detecting device, a material loading mechanism for placing materials and driving the materials to rise and fall, a material taking mechanism for transferring the materials and a height detecting mechanism for detecting the height of the materials, wherein, the material thickness detecting device, the material loading mechanism, the material taking mechanism and the height detecting mechanism are respectively connected to the main controller, the height detecting mechanism includes a bracket and a height testing part connected to the bracket, and a detector for detecting the distance of the materials is arranged on the height testing part.

As a further improvement of the invention, the height testing part is a bracket capable of rotating up and down. The bracket capable of rotating up and down is rotationally connected to the bracket of the height detecting mechanism. The detector is a magnet and the magnet is arranged on the bracket capable of rotating up and down, and a detection circuit for detecting the magnetic force change of the magnet is arranged on the bracket of the height detecting mechanism.

As a further improvement of the present invention, the material loading mechanism includes a motor. The placing platform connected to the motor, and the bracket capable of rotating up and down is parallel to the rotation axis of the bracket and the placing platform.

As a further improvement of the invention, the detection circuit is located directly above the magnet.

As a further improvement of the invention, the detection circuit is connected to the main controller.

The invention also provides an automatic lifting feeding method, which includes the following steps:

S1, the material is placed on the material loading mechanism, and the rise of the material loading mechanism is controlled by the main controller;

S2, through the height detection mechanism, the lifting height of the material is detected and sent to the main controller;

S3, through the main controller, whether the lifting height of the material matches the predetermined height for transferring is determine. If the lifting height is not at the predetermined height for transferring, then process returns to step S1. If the lifting height reaches to the predetermined height for transferring, the material loading mechanism is controlled to stop by the main controller, and the material taking mechanism is controlled to take the material by the main controller.

As a further improvement of the present invention, the magnetic variation is used to detect the rising height of the material. The magnet is fixed on the bracket capable of rotating up and down, the bracket capable of rotating up and down is arranged on the bracket of the height detecting mechanism, so that the bracket capable of rotating up and down can rotate up and down around the bracket of the height detecting mechanism. The detection circuit is arranged on the bracket of the height detecting mechanism, the bracket capable of rotating up and down is placed on the material. The material drives the bracket capable of rotating up and down to rotate when the material is driven to rise by the material loading mechanism. The magnet is close to the detection circuit, the detection circuit acquires the analog signal carrying the information of the magnetic force change of the magnet and then transmits the analog signal to the main controller. The main controller converts the analog signal to a digital signal and then compares the digital signal with the preset parameter value, thereby determining whether to lift the material or take the material.

As a further improvement of the present invention, the predetermined parameter value is a reference value for a variety of thicknesses set after the materials having various thicknesses are tested, and the predetermined parameter value is stored in the main controller.

As a further improvement of the present invention, the thickness of the material is recorded by the material thickness detecting device.

The advantages of the invention are: Through the technical solution disclosed above, it is not necessary to adjust the height manually, the material height can be automatically detected, and the efficiency is increased compared to other methods in the art.

BRIEF DESCRIPTION OF THE DRAWING

FIGURE is a schematic diagram of the automatic lifting feeding device of the invention.

DETAILED DESCRIPTION OF THE EMBODIMENTS

The invention is further explained with reference to the drawing and the specific embodiment.

As shown in the FIGURE, an automatic lifting feeding device includes the main controller 8, the material thickness detecting device 10, the material loading mechanism 5 for placing the material 6 and driving the material 6 to lift, the material taking mechanism 7 for transferring the material 6 and the height detecting mechanism for detecting the height of the material 6, wherein, the material thickness detecting device 10, the material loading mechanism 5, the material taking mechanism 7 and the height detecting mechanism are respectively connected to the main controller 8; the height detecting mechanism includes the bracket 3 and the height testing part connected to the bracket 3, and the detector for detecting the distance of the material is arranged on the height testing part; the height detecting mechanism analyzes the small change of distance between adjacent moveable objects in real time, so as to provide reliable material taking manners, through quantifying the digital signal including magnetic change, ultrasonic detection, optical detection and the like. The specific embodiment provided by the invention is magnetic change, but not limited to the magnetic change.

As shown in the FIGURE, the height testing part is the bracket 2 capable of rotating up and down, the bracket 2 capable of rotating up and down is rotationally connected to the bracket 3, the detector is the magnet 1 arranged on the bracket 2 capable of rotating up and down, and the bracket 3 is provided with the detection circuit 4 for detecting the change of the magnetic force of the magnet 1.

As shown in the FIGURE, the material loading mechanism 5 includes the motor 9 and a placing platform connected to the motor 9, the bracket 2 capable of rotating up and down is parallel to the rotation axis of the bracket 3 and the placing platform.

As shown in the FIGURE, the detection circuit 4 is located directly above the magnet 1.

As shown in the FIGURE, the detection circuit 4 is connected to the main controller 8.

As shown in the FIGURE, an automatic lifting feeding method includes the following steps: S1, the material 6 is placed on the material loading mechanism 5, and the material loading mechanism 5 is controlled to rise through the main controller 8;

S2, through the height detecting mechanism, the lifting height of the material 6 is detected and sent to the main controller 8;

S3, through the main controller 8, whether the lifting height of the material 6 reaches the predetermined height for transferring, if the lifting height of the material 6 does not reach to the predetermined height for transferring, the process returns to step S1; if the lifting height of the material 6 reaches the predetermined height for transferring, the material loading mechanism 5 is controlled to stop by the main controller 8, and the material taking mechanism 7 is controlled to take the material by the main controller 8.

As shown in the FIGURE, the magnetic variation is used to detect the lifting height of the material 6, specifically: the magnet 1 is fixed on the bracket 2 capable of rotating up and down, the bracket 2 capable of rotating up and down is mounted on the bracket 3, so that the bracket 2 capable of rotating up and down can rotate around the bracket 3 up and down. The detection circuit 4 is mounted on the bracket 3, the bracket 2 capable of rotating up and down is placed on the material, when the material loading mechanism 5 drives the material 6 to rise, the material 6 drives the bracket 2 capable of rotating up and down to rotate, the magnet 1 is driven to rise by the bracket 2 capable of rotating up and down. The magnet 1 is close to the detection circuit 4, and the detection circuit 4 obtains the analog signal of the magnetic force change of the magnet 1 and then sends the analog signal to the main controller 8, the main controller 8 converts the analog signal to the digital signal and then compare the digital signal with the predetermined parameter value, thereby judging whether to lift the material or take the material.

As shown in the FIGURE, the predetermined parameter value is a reference value for a variety of thicknesses set after the materials having various thicknesses are tested. The predetermined parameter value is stored in the main controller. When the predetermined value is defective, which leads to material taking failure or multiple materials taken at once, the predetermined value can be manually adjusted through the interface or automatically adjusted by the main controller according to the proportion of the feeding error in the user process, thereby self-learning and approaching the optimal value. The present invention automatically learns and stores relationship of variable position parameters of different materials and adjacent objects, thereby realizing a self-adaptation.

As shown in the FIGURE, the thickness of the material is recorded by the material thickness detecting device 10, and then corresponds to the above-mentioned optimum value, so that the optimum value needed by the material is memorized in the main controller 8, and the predetermined value is automatically accessed when the similar material is used next time.

The invention provides an automatic lifting feeding device and method, which has the following advantages:

1. The invention does not need manual intervention to adjust the height of the material placing mechanism, thereby reducing the waste of materials due to the repeated adjustment and testing of the height.

2. The best height value can be obtained quickly, improving work efficiency.

3. The predetermined value can be automatically corrected in operation, ensuring the stability and speed of feeding in operation, and reducing errors and wastes.

The above content is further detailed description of the invention in combination with a specific preferred embodiment, and one should not conclude that the specific implementation of the invention is limited to these descriptions. For the ordinary skilled person in the art, without departing from the concept of the invention, a plurality of simple deductions or replacements can be made, and all of them shall be considered within the protection scope of the invention.

What is claimed is:

1. An automatic lifting feeding device, comprising:

a main controller, a material thickness detecting device, a material loading mechanism for placing a material and driving the material to rise and fall, a material taking mechanism for transferring the material, and a height detecting mechanism for detecting a height of the material, wherein the material thickness detecting device, the material loading mechanism, the material taking mechanism and the height detecting mechanism are respectively connected to the main controller, the height detecting mechanism comprises a first bracket and a second bracket, wherein the second bracket rotates up and down and is rotationally connected to the first bracket, a magnet is arranged on the second bracket for detecting a distance to the material, and the first bracket is provided with a detection circuit for detecting a change of a magnetic force of the magnet, wherein the material loading mechanism comprises a motor and a placing platform connected to the motor, the second bracket is parallel to a rotation axis of the first bracket and the placing platform, and wherein the detection circuit is located directly above the magnet.

2. The automatic lifting feeding device of claim 1, wherein the detection circuit is connected to the main controller.

3. A method of automatic lifting feeding based on the automatic lifting feeding device of claim 1, comprising the following steps:

S1, placing the material on the material loading mechanism, and controlling a rise of the material loading mechanism by the main controller;

S2, through the height detecting mechanism, detecting a lifting height of the material and sending the lifting height to the main controller;

S3, through the main controller, determining whether the lifting height of the material reaches a predetermined height for transferring, if not reaching to the predetermined height for transferring, then returning step S1; if reaching the predetermined height for transferring, controlling the material loading mechanism to stop by the main controller, and controlling the material taking mechanism to take the material by the main controller.

4. The method of claim 3, wherein a magnetic variation is configured to detect the lifting height of the material, the magnet is fixed on the second bracket, the second bracket is arranged on the first bracket, so that the second bracket rotates up and down around the first bracket, the detection circuit is arranged on the first bracket, the second bracket is placed on the material, the material drives the second bracket to rotate when the material is driven to rise by the loading mechanism, the magnet is driven to rise by the second bracket, the magnet is arranged below the detection circuit, the detection circuit acquires an analog signal related to a magnetic force change of the magnet and then transmits the analog signal to the main controller, the main controller converts the analog signal to a digital signal and then compares the digital signal with a predetermined parameter value, thereby judging whether to lift the material or take the material.

5. The method of claim 4, wherein the predetermined parameter value is a reference value for a variety of thicknesses predetermined after materials having various thicknesses are tested, the predetermined parameter value is stored in the main controller.

6. The method of claim 4, wherein a thickness of the material is recorded by the material thickness detecting device.

* * * * *